US005800233A

United States Patent [19]

Yano et al.

[11] Patent Number: 5,800,233

[45] Date of Patent: Sep. 1, 1998

[54] PROCESS OF FABRICATING FIELD-EMISSION TYPE ELECTRON SOURCE, ELECTRON SOURCE FABRICATED THEREBY AND ELEMENT STRUCTURE OF ELECTRON SOURCE

[75] Inventors: Seiki Yano, Yamatokoriyama; Masao Urayama, Misato; Yoshiyuki Takegawa, Kashiwa; Yuko Morita, Matsudo, all of Japan

[73] Assignee: Sharp Kabushiki Kaisha, Osaka, Japan

[21] Appl. No.: 599,315

[22] Filed: Feb. 9, 1996

[30] Foreign Application Priority Data

Apr. 3, 1995 [JP] Japan ..... 7-077800

[51] Int. Cl.[6] ..... H01J 9/40

[52] U.S. Cl. ..... 445/25; 445/58

[58] Field of Search ..... 445/50, 58, 25

[56] References Cited

U.S. PATENT DOCUMENTS

| | | | |
|---|---|---|---|
| 3,678,325 | 7/1972 | Nishida et al. . | |
| 4,908,539 | 3/1990 | Meyer | 315/169.3 |
| 5,089,292 | 2/1992 | MaCaulay et al. | 313/336 X |
| 5,186,670 | 2/1993 | Doan et al. | 445/50 X |
| 5,199,917 | 4/1993 | MacDonald et al. | 445/50 X |
| 5,394,006 | 2/1995 | Liu | 445/50 X |

FOREIGN PATENT DOCUMENTS

| | | |
|---|---|---|
| 2672734 | 8/1992 | France . |
| 594762 | 4/1993 | Japan . |
| 2274198 | 7/1994 | United Kingdom . |

OTHER PUBLICATIONS

Masao Urayama et al., "Silicon Field Emitter Capable of Low Voltage Emission", Jpn. J. Appl. Phys., vol. 32, Part 1, No. 12B (Dec. 1993), pp. 6293–6296.

J.P. Spallas et al. "Self-Aligned Silicon Field Emission Cathode Arrays Formed By Selective, Lateral Thermal Oxidation Of Silicon," *Journal of Vacuum Science and Technology*, Part B, vol. 11, No. 2, Mar. 1, 1993, pp. 437–440.

*Primary Examiner*—Kenneth J. Ramsey

[57] ABSTRACT

A cathode is formed on a glass substrate by depositing nickel thereon, and silicon dioxide is allowed to accumulate on the cathode by sputtering to form an insulator film. Then, a gate electrode is provided on the insulator film by depositing nickel thereon. A hole is formed on the glass substrate by lithography to carry out patterning, and the gate electrode and the insulator film are selectively etched to create a hole for the formation of an emitter emitting electrons. Furthermore, nickel is stacked into the hole by deposition to form the emitter, and subsequently the emitter is covered with sulfur as a high vapor-pressure substance to form a high vapor-pressure substance layer.

12 Claims, 4 Drawing Sheets

PROCESS OF FABRICATING FIELD-EMISSION TYPE ELECTRON SOURCE, ELECTRON SOURCE FABRICATED THEREBY AND ELEMENT STRUCTURE OF ELECTRON SOURCE

BACKGROUND OF THE INVENTION (1) Field of the Invention

The present invention relates to a process of fabricating a field-emission type electron source for millimeter wave devices, display devices or high-power microwave devices, an electron source fabricated thereby and an element structure of the electron source, whereby leading to high efficiency and high reliability of vacuum micro devices.

(2) Description of the Prior Art

The term 'vacuum micro device' is used for a device which is designed by using the micro-miniature fabricating technologies so as to be able to generate intensive electric fields with application of small voltages and to cause field emission of electrons in the vacuum. FIG. 5 is a sectional view showing an element structure of a conventional field-emission type electron source. As shown in FIG. 5, a cathode 32 of molybdenum (Mo) is deposited on a glass substrate 31, and an insulator film 33 of silicon dioxide ($SiO_2$) is deposited on the cathode 32. Then, a gate electrode 34 of Mo is formed on the insulator film 33, and an emitter 35 of Mo is formed in a hole created by etching the gate electrode 34 and the insulator film 33.

FIG. 6 is a sectional view showing an element structure of a conventional field-emission type electron source which has an emitter of silicon (Si) formed on a Si substrate by processing the Si substrate. As shown in FIG. 6, an insulator film 38 is formed on a Si-substrate 37, and a gate electrode 39 is provided on the insulator film 38. Then, an emitter 40 of Si is formed in a hole created by etching the gate electrode 39 and the insulator film 38. In the final step, a cathode 36 is formed on the undersurface of the Si-substrate 37.

In the element structures of the conventional electron sources stated above, the emitter of Mo or Si is exposed to the air, the topmost source layer of the emitter is oxidized in some tens of angstroms. Such an electron source having the thus oxidized emitter suffered from an operational problem that the number of emitted electrons becomes extremely low. To avoid this, in a typical fabricating process, the electron source is heat-treated a whole day and night at an elevated temperature of up to 300° C. as in an air-sucking vacuum system, thereby removing the oxide film. It is true that conducting such a complicated process is able to solve the above operational problem, but it is difficult to improve the reliability of the element and simplify the process to reduce the cost.

SUMMARY OF THE INVENTION

The present invention has been achieved to solve the above conventional problems, and it is therefore an object of the present invention to provide a process of fabricating a field-emission type electron source, an electron source fabricated by the process and an element structure of the electron source, whereby it is possible to prevent emitters from being oxidized and to simplify the process.

In accordance with one aspect of the invention, there is provided a process of fabricating a field-emission type electron source that emits electrons based on the principle of field-emission includes the steps of: forming an emitter emitting electrons on a substrate; and covering the emitter with a high vapor-pressure substance having a vapor pressure of $8\times10^{-8}$ Torr or more at a temperature of 200° C.

In accordance with another aspect of the invention, there is provided a field-emission type electron source, which emits electrons based on the principle of field-emission, fabricated by a process including the steps of: forming an emitter emitting electrons on a substrate; and covering the emitter with a high vapor-pressure substance having a vapor pressure of $8\times10^{-8}$ Torr or more at a temperature of 200° C.

In accordance with still another aspect of the invention, there is provided an element structure of a field-emission type electron source emitting electrons based on the principle of field-emission includes: a substrate; an emitter, emitting electrons, formed on the substrate; and a high vapor-pressure substance layer covering the emitter and having a vapor pressure of $8\times10^{-8}$ Torr or more at a temperature of 200° C.

In accordance with a process of fabricating a field-emission type electron source, an electron source produced thereby and an element structure of the electron source, it is possible to prevent the emitter from being oxidized even if the electron source is exposed to the air because the emitter surface is covered with a high vapor-pressure substance. As a result, it is possible to store a large amount of electron sources produced at the same time, whereby it is possible to simplify the production process.

Further advantages and features of the invention as well as the scope, nature and utilization of the invention will become apparent to those skilled in the art from the description of the preferred embodiments of the invention set forth below.

DESCRIPTION OF THE PREFERRED EMBODIMENTS

Figure 1:
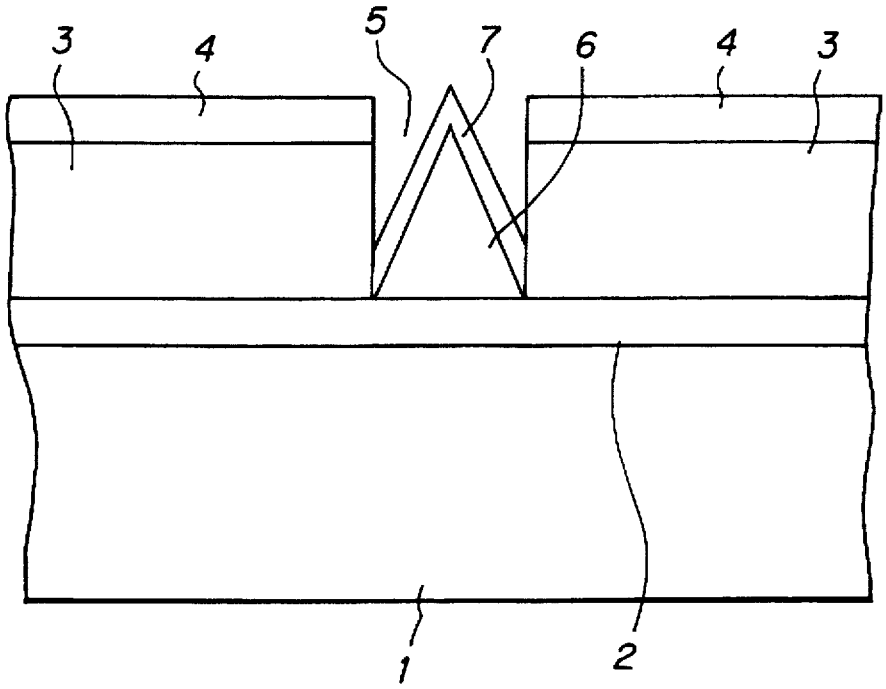
FIG. 1 is a sectional view showing an embodiment of an element structure of a field-emission type electron source in accordance with the present invention.

As stated above, a process of fabricating a field-emission type electron source that emits electrons based on the principle of field-emission in accordance with the present invention includes the steps of: forming an emitter emitting electrons on a substrate; and covering the emitter with a high vapor-pressure substance having a vapor pressure of $8\times10^{-8}$ Torr or more at a temperature of 200° C.

A field-emission type electron source that emits electrons based on the principle of field-emission in accordance with the present invention is fabricated by a process including the steps of: forming an emitter emitting electrons on a substrate; and covering the emitter with a high vapor-pressure substance having a vapor pressure of $8 \times 10^{-8}$ Torr or more at a temperature of 200° C.

In the process of fabricating a field-emission type electron source as well as the field-emission type electron source fabricated by the process, it is preferable to evaporate a high vapor-pressure substance covering the emitter while heat-treating the emitter in a vacuum, and then to vacuum-seal the electron source. Thereby, it is possible to securely keep the emitter surface clean, whereby the electron source is adapted to be able to emit electrons in a short period of time after the fabrication. More preferably, the emitter is heat-treated in a vacuum together with a getter. The getter captures the high vapor-pressure substance evaporated, so that it is possible to securely keep the emitter surface clean without lowering the degree of vacuum.

An element structure of a field-emission type electron source that emits electrons based on the principle of field-emission includes: a substrate; an emitter, emitting electrons, formed on the substrate; and a high vapor-pressure substance layer covering the emitter and having a vapor pressure of $8\times10^{-8}$ Torr or more at a temperature of 200° C.

The substrate used in the invention is preferably of glass or silicon. When a substrate of silicon is used, it is preferable that the emitter emitting electrons is formed by processing the silicon substrate itself. On the other hand, when a substrate of glass is used, the emitter emitting electrons should be formed on the glass substrate with a cathode therebetween.

In the invention, a high vapor-pressure substance having a vapor pressure of $8\times10^{-8}$ Torr or more at 200° C. is used for covering, or masking the emitter. This is because 200° C. is a temperature required for heat-treatment and $8\times10^{-8}$ Torr is a level of vacuum required for sealing the electron source in a vacuum, or vacuum-sealing.

Examples of the high vapor-pressure substance include, cadmium, lithium, magnesium, rubidium, sulfur, antimony, selenium, tellurium, zinc and the like, and the substance may a mixture of these elements.

Further, for the application of the electron source to the utility requiring an intensive current, the emitter should be composed of a high-melting point substance having a melting point of 1,500° C. or more, alternatively the emitter should be covered with a high-melting point substance having a melting point of 1,500° C. or more. This is because if a substance having a melting point of lower than 1,500° C. is used to try to obtain an emitter-current of 10 μA/tip, the substance will become melted.

Examples of the high-melting point substance include, iridium, osmium, chromium, zirconium, tungsten, carbon, tantalum, platinum, vanadium, palladium, boron, molybdenum, ruthenium, rhenium, hafnium, niobium, rhodium and the like, and the substance may a mixture of these elements.

According to the invention, since the emitter surface is covered with a high vapor-pressure substance, the emitter is prevented from being oxidized when the electron source is taken out in the air. Since the electron source is heat-treated in a vacuum to evaporate the high vapor-pressure substance covering the emitter, the surface of the emitter is secured to be clean.

EXAMPLES

Embodiments of the invention will hereinbelow be described in detail with reference to the drawings.

Example 1

FIG. 1 is a sectional view showing an embodiment of an element structure of a field-emission type electron source in accordance with the invention. As shown in FIG. 1, initially, nickel (Ni) was vapor-deposited on a glass substrate 1 by the electron-beam deposition technique to form a cathode 2 of 4000 Å thick. Then, $SiO_2$ was stacked on the cathode 2 by spattering so as to form an insulator film 3 of 1 μm thick. Thereafter, nickel was vapor-deposited on the insulator film 3 by the electron-beam deposition technique to form a gate electrode 4 of 4000 Å thick.

The thus formed multi-layer glass substrate was patterned to make a hole of 2 μm in diameter at a pitch of 5 μm using the lithography technique. The gate electrode 4 and insulator film 3 were selectively etched by the reactive ion etching (RIE) technique so as to form a hole 5 for producing an emitter for releasing electrons on the basis of the principle of the filed-emission effect. Thereafter, Ni was stacked in the hole 5 by the electron-beam deposition technique to form a conically projected emitter 6. Subsequently, sulfur (to be referred to as S) as a high vapor-pressure substance was deposited on the emitter 6 to form a high vapor-pressure substance layer 7 of 200 Å thick covering the emitter 6.

The field-emission type electron source thus fabricated by the above process was set together with an anode in the vacuum container and the degree of vacuum was elevated to $10^{-8}$ Torr. In this condition, the electron source was heated for ten minutes at 300° C. to eject gases out. Since the temperature for the treatment was sufficiently higher than −10° C. at which the vapor pressure of S would become $10^{-8}$ Torr, the sulfur having covered the emitter 6 was evaporated and ejected out from the surface of the emitter, the pure Ni appeared on the surface of the emitter 6. Thereafter, in the condition where the anode was applied with +100 V, a voltage was applied with the cathode 2 negative and the gate electrode 4 positive, a stable anode-current of 100 μA was obtained at 60 V.

As an alternative method of removing the high vapor-pressure substance layer, the high vapor-pressure substance layer was removed in a vacuum sealed system using a getter. Specifically, the electron source fabricated in the above process was set together with an anode and a non-volatile getter (zirconium-aluminum) in a vacuum container, and the degree of vacuum was elevated to $10^{-8}$ Torr. In this condition, the electron source was heated for ten minutes at 300° C. to eject gases out. As the sulfur evaporated, the getter presented its getter-effect and absorbed S. As a result, the pure Ni-layer appeared on the surface of the emitter 6 without lowering the degree of vacuum. The thus obtained electron source was tested in the condition where the anode was applied with +100 V and a voltage was applied with the cathode 2 negative and the gate electrode 4 positive. As a result, a stable anode-current of 100 μA was obtained at 60 V.

Example 2

The maximum current obtainable from an electron source is limited by the melting of the emitter due to the temperature rise attributed to the Nottingham effect and Joule heat. Accordingly, for the application of an electron source to the utility requiring an intensive current, a metal having a high melting point should be employed as an emitter material. To achieve this, molybdenum (Mo) was used in place of Ni as the material for the emitter in example 1. The gate electrode and cathode were also composed of Mo. The other conditions of the fabrication were the same as in example 1. The thus obtained electron source was tested in the condition where the anode was applied with +100 V and a voltage was applied with the cathode 2 negative and the gate electrode 4 positive. As a result, a stable anodecurrent of 1 mA was obtained at 60 V.

Example 3

Figure 2A:
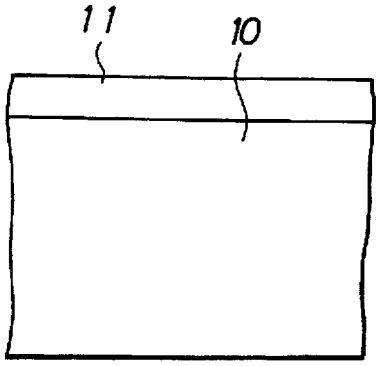
FIGS. 2A through 2F are sectional views showing an example of a fabrication process of a field-emission type electron source by performing the micro-miniature processing of a silicon substrate.
Figure 2D:
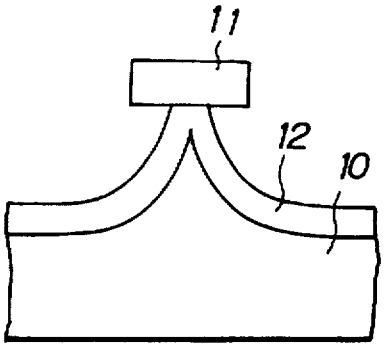
Figure 2B:
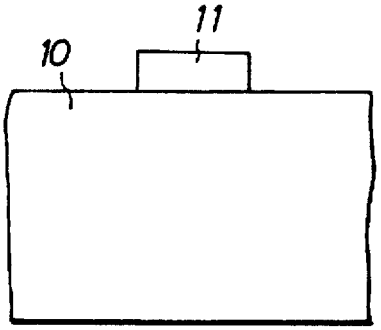
Figure 2E:
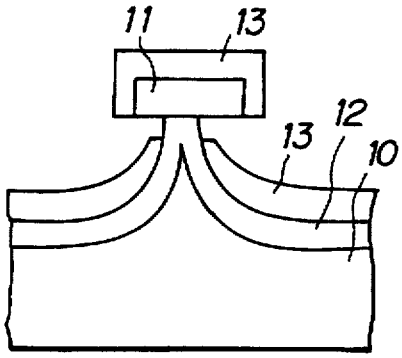

FIGS. 2A through 2F are views showing an example of the fabrication process of a field-emission type electron source by performing the micro-miniature processing of a silicon substrate. FIG. 3 is a sectional view showing a state in which a high vapor-pressure substance layer is formed in the electron source shown in FIG. 2.

First, a Si-substrate 10 having a resistivity ρ of 2 to 3 Ωcm was cleaned by the normal RCA cleaning technique. The thus cleaned substrate 10 was formed with an oxide film ($SiO_2$) 11 of 3000 Å thick, by the wet-oxidation for 22 min. at 1,100° C., as shown in FIG. 2A. The formed oxide film 11 was patterned with 3 μm in diameter at a pitch of 5 μm using the normal lithographic technique. Then, the oxide film 11 was etched by the reactive ion etching (RIE) technique so was to leave only the circular portion of 3 μm in diameter as shown in FIG. 2B.

Figure 2C:
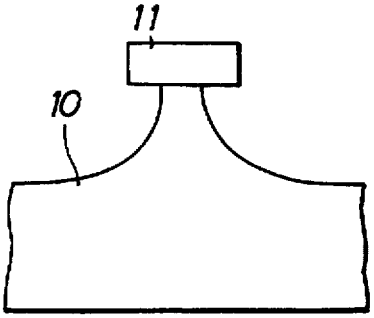
Figure 3:
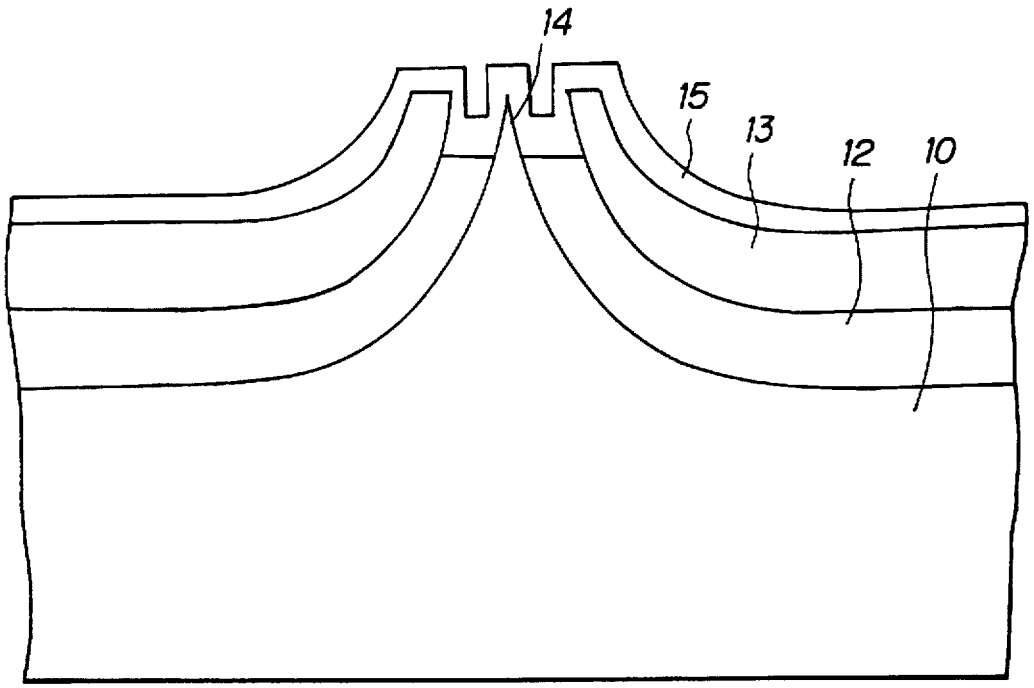
FIG. 3 is a sectional view showing a state in which a high vapor-pressure substance layer is formed in the electron source shown in FIG. 2.

Then, as shown in FIG. 2C, Si-substrate 10 was selectively etched under the use of the circular oxide film 11 as a mask. The Si-substrate 10 was etched by a depth of 2 μm. In this etching, the masked part of Si-substrate was shaped into a shape having a vertical section of trapezoid with its base placed horizontally and having an upper-base of 8,000 Å in size. Thereafter, wet-oxidation for 34 min. at 1,100° C. was effected so that the Si-substrate 10 was formed with an oxide film 12 of 4,000 Å thick on the surface thereof, as shown in FIG. 2D.

Figure 2F:
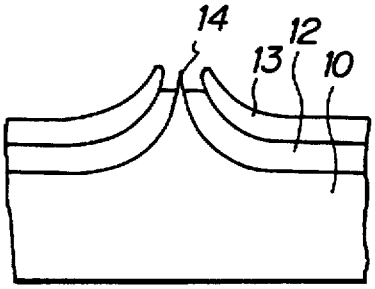

Subsequently, as shown in FIG. 2E, a gate electrode 13 was formed by the electron-beam deposition technique using niobium (Nb) as a gate metal so that the resultant electrode was angled 50° C. relative to a normal of the substrate surface. The thickness of the gate electrode 13 was 4000Å. As shown in FIG. 2F, the circular oxide film 11 and the oxide film 12 around the emitter 14 were removed by the reactive ion etching (RIE) technique. Finally, S was stacked on the surface of the electron source obtained by effecting the resistance-heating process in the same apparatus as in Example 1 to form a high vapor-pressure substance layer 15 of 200 Å thick, as shown in FIG. 3.

The electron source thus fabricated by the above process was set together with an anode in the vacuum container, in the same manner as example 1, and the degree of vacuum was elevated to $10^{-8}$ Torr. In this condition, the substrate was heated for ten minutes at 300° C. to eject gases out. Since the temperature for the treatment was sufficiently higher than −10° C. at which the vapor pressure of S would become $10^{-8}$ Torr, S having covered the emitter was evaporated and ejected out from the surface of the emitter, and pure Si appeared on the surface of the emitter. The thus obtained electron source was tested in the condition where the anode was applied with +100 V and a voltage was applied with the cathode negative and the gate electrode positive. As a result, a stable anode-current of 10 μA was obtained at 60 V.

Example 4

Figure 4:
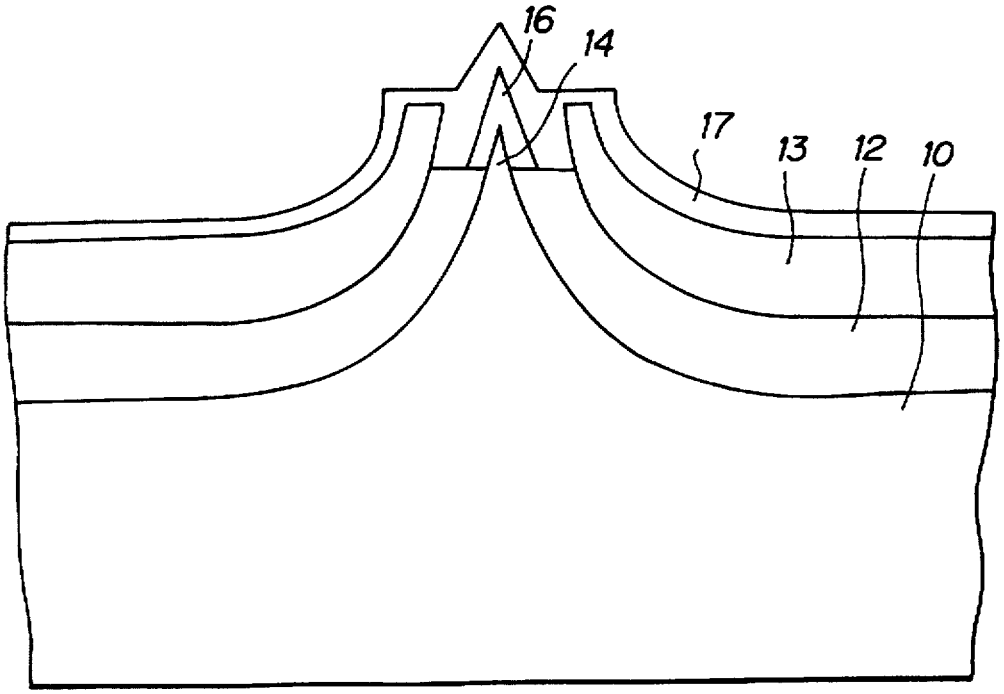
FIG. 4 is a sectional view showing a state in which a high-melting point substance layer is formed on the surface of the emitter shown in FIG. 2.
Figure 5:
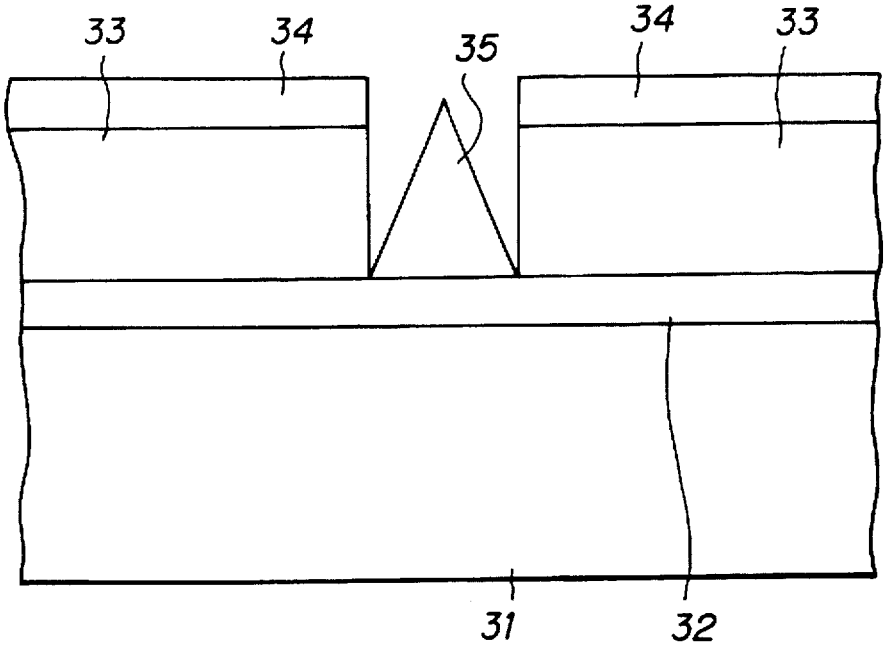
Fig.5 Prior Art
FIG. 5 is a sectional view showing an element structure of a conventional field-emission type electron source.
Figure 6:
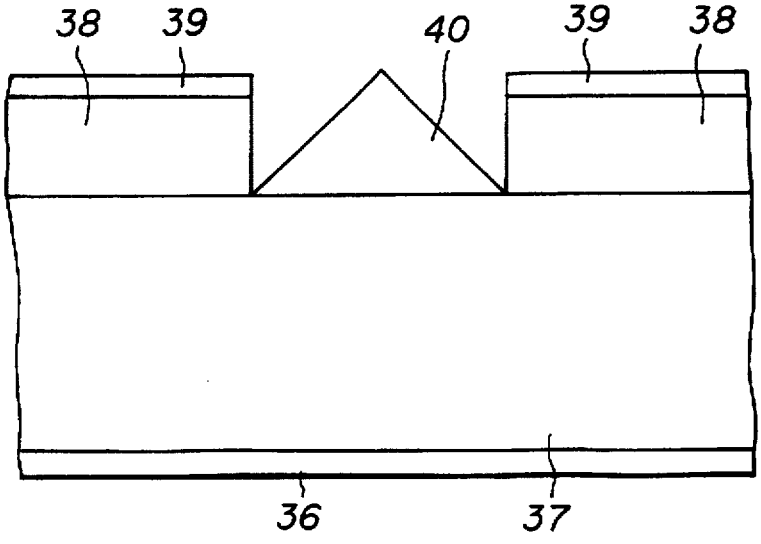
Fig.6 Prior Art
FIG. 6 is a sectional view showing an element structure of a conventional field-emission type electron source having an emitter formed by processing a silicon substrate.

In this example, a Si-emitter 14 was formed by removing the circular oxide film and the oxide film around the emitter in the same manner as in example 3. Thereafter, tungsten (W) was stacked on the surface of the emitter 14 by the electron-beam deposition technique to form a high-melting point metal layer 16. Further, S was stacked over the high-melting point metal layer 16 by the electron-beam deposition technique to form a high vapor-pressure substance layer 17. The configuration is shown in FIG. 4. Here, for the removal of the circular oxide film, buffered hydrofluoric acid was used. In this case, the surface of the Si-emitter was more or less oxidized before the vapor-deposition of W, but this did not affect the electron emission since the surface in question was not the surface from which electrons would be emitted.

The electron source thus fabricated by the above process was set together with an anode in the vacuum container, in the same manner as example 1, and the degree of vacuum was elevated to $10^{-8}$ Torr. In this condition, the electron source was heated for ten minutes at 300° C. to eject gases out. Since the temperature for the treatment was sufficiently higher than −10° C. at which the vapor pressure of S would become $10^{-8}$ Torr, S having covered the emitter was evaporated and ejected out from the surface of the emitter, the pure W appeared on the surface of the emitter. The thus obtained electron source was tested in the condition where the anode was applied with +100 V and a voltage was applied with the cathode negative and the gate electrode positive. As a result, a stable anode-current of 1 mA was obtained at 60 V.

As has been described heretofore, in accordance with the invention, since the emitter surface is covered with a high vapor-pressure substance, it is possible to prevent the emitter from being oxidized even when the electron source is taken out in the air. Accordingly, the electron source can be stored when many electron sources are fabricated at the same time, whereby it is possible to simplify the production process. Since the surface of the emitter can be secured to be clean when the high vapor-pressure substance is evaporated by heating the electron source in a vacuum, the electron source is adapted to be able to emit electrons in a short period of time after the fabrication. As a result, it is possible to reduce the cost of the device as well as to improve the reliability of the device.

What is claimed is:

1. A process of fabricating a field-emission type electron source that emits electrons based on the principle of field-emission, comprising the steps of:

forming an emitter emitting electrons on a substrate;

covering said emitter with a high vapor-pressure substance having a vapor pressure of $8\times10^{-8}$ Torr or more at a temperature of 200° C.; and evaporating said high vapor-pressure substance covering said emitter.

2. The process of fabricating a field-emission type electron source according to claim 1, further comprising the steps of:

heat-treating said emitter in a vacuum; and vacuum-sealing the electron source.

3. the process of fabricating a field-emission type electron source according to claim 1, further comprising the steps of:

heat-treating said emitter together with a getter in a vacuum;

allowing said getter to capture the evaporated high vapor-pressure substance; and vacuum-sealing the electron source.

4. The process of fabricating a field-emission type electron source according to claim 1, wherein said substrate comprises glass, and said emitter is formed on said substrate with a cathode therebetween.

5. The process of fabricating a field-emission type electron source according to claim 1, wherein said substrate comprises silicon, and said emitter is formed by processing said substrate.

6. The process of fabricating a field-emission type electron source according to claim 1, wherein said emitter comprises a high-melting point substance having a melting point of 1,500° C. or more.

7. An element structure of a field-emission type electron source emitting electrons based on the principle of field-emission, comprising:

a substrate;

an emitter; emitting electrons, formed on said substrate; and a high vapor-pressure substance layer covering said emitter and having a vapor pressure of $8\times10^{-8}$ Torr or more at a temperature of 200° C.;

wherein said high vapor-pressure substance has the physical property of being evaporable from the emitter, so that the electron source can be vacuum sealed without the covering substance.

8. The element structure of a field-emission type electron source according to claim 7, wherein said substrate comprises glass, and said emitter is formed on said substrate with a cathode therebetween.

9. The element structure of a field-emission type electron source according to claim 7, wherein said substrate comprises silicon, and said emitter is formed by processing said substrate.

10. The element structure of a field-emission type electron source according to claim 7, wherein said emitter comprises a high-melting point substance having a melting point of 1,500° C. or more.

11. The elemental structure of a field-emission type electron source according to claim 10, wherein said high-melting point substance is selected from the group consisting of iridium, osmium, chromium, zirconium, tungsten, carbon, tantalum, platinum, vanadium, palladium, boron, molybdenum, ruthenium, rhenium, hafnium, niobium, rhodium and mixtures thereof.

12. The element structure of a field-emission type electron source according to claim 7, wherein said high vapor-pressure substance layer comprises a high vapor-pressure substance selected from the group consisting of cadmium, lithium, magnesium, rubidium, sulfur, antimony, selenium, tellurium, zinc and mixtures thereof.

* * * * *